US010366677B2

(12) United States Patent
Tagliapini et al.

(10) Patent No.: US 10,366,677 B2
(45) Date of Patent: Jul. 30, 2019

(54) STRING INSTRUMENT WITH RESONATOR

(71) Applicant: Angelo Tagliapini, Gardone Riviera (IT)

(72) Inventors: Angelo Tagliapini, Gardone Riviera (IT); Giorgio Tagliapini, Gardone Riviera (IT)

(73) Assignee: Angelo Tagliapini, Gardone Rivera (BS) (IT)

( * ) Notice: Subject to any disclaimer, the term of this patent is extended or adjusted under 35 U.S.C. 154(b) by 59 days.

(21) Appl. No.: 15/546,158

(22) PCT Filed: Feb. 22, 2016

(86) PCT No.: PCT/IB2016/050930
§ 371 (c)(1),
(2) Date: Jul. 25, 2017

(87) PCT Pub. No.: WO2016/135608
PCT Pub. Date: Sep. 1, 2016

(65) Prior Publication Data

US 2018/0012575 A1 Jan. 11, 2018

(30) Foreign Application Priority Data

Feb. 26, 2015 (IT) ..... BS2015A0027

(51) Int. Cl.
*G01D 3/02* (2006.01)
*G10D 3/02* (2006.01)
(Continued)

(52) U.S. Cl.
CPC ..... *G10D 3/02* (2013.01); *G10D 1/08* (2013.01); *G10D 3/04* (2013.01); *G10D 3/10* (2013.01); *G10H 3/18* (2013.01)

(58) Field of Classification Search
CPC .. G10D 3/04; G10D 3/02; G10D 3/10; G10D 1/08; G10H 3/18
See application file for complete search history.

(56) References Cited

U.S. PATENT DOCUMENTS 4,051,761 A 10/1977 Nylen
4,467,692 A * 8/1984 Egan ..... G10D 3/02 84/291

(Continued)

FOREIGN PATENT DOCUMENTS

DE 19617292 A1 11/1997
FR 373598 A 5/1907

*Primary Examiner* — Kimberly R Lockett
(74) *Attorney, Agent, or Firm* — Volpe and Koenig, P.C.

(57) ABSTRACT

The present invention relates to a string instrument (1; 100) comprising a resonator (2), a handle (3) and a tailpiece (4; 40), wherein the handle (3) and the tailpiece (4; 40) are bound to the resonator (2) for combining at least one string to the instrument, further comprising at least one couple of magnets essentially opposed each other, a first magnet (11; 110) of the at least one couple of magnets bound to the resonator (2) and a second magnet (12; 120) of the at least one couple of magnets arranged at a first distance from the first magnet, so that to apply, between the first magnet (11; 110) and the second magnet (12; 120), a repulsive force or an attractive force, respectively, depending on the opposed polarities, equal or opposite, of the first magnet and the second magnet, wherein the attractive force or the repulsive force is active on the resonator (2).

11 Claims, 5 Drawing Sheets

(51) Int. Cl.

| | |
|---|---|
| ***G10D 1/08*** | (2006.01) |
| ***G10D 3/04*** | (2006.01) |
| ***G10D 3/10*** | (2006.01) |
| *G10H 3/18* | (2006.01) |

(56) References Cited

U.S. PATENT DOCUMENTS

| | | | | |
|---|---|---|---|---|
| 7,678,979 | B1 | 9/2010 | Roop | |
| 8,247,678 | B1 | 8/2012 | Ivy | |
| 2009/0188370 | A1 * | 7/2009 | DeJule | G10D 3/046 84/294 |

* cited by examiner

STRING INSTRUMENT WITH RESONATOR

DESCRIPTION

Field of the Invention

In its most general aspect the present invention refers to the technical field of musical instruments and, in particular, it refers to string instruments also known as chordophones, whose strings are rubbed by a bow or plucked.

Still more in particular, the invention relates to a string instrument of the afore said type comprising a resonator as element integral with the instrument.

State of the Art

As known, in musical string instruments the sound produced by mechanical stimulation of strings can be amplified by a suitable element, usual named resonator.

A resonator, in particular a resonator meant as element integral with the instrument, i.e. an element being one with the instrument, can be constituted by a sound board, also known as resonance board, or else it can comprise a sound board as the front part of a sound box or resonance box.

In this kind of instruments the sound is amplified, inter alia, also by vibration of the sound board that is caused by string vibration and, as it were, is expanded in the sound box, if present.

In this regard, in modern liutery two alternative techniques are usually employed for realizing string instruments comprising a resonator as a part integral with the instrument, which are essentially different from one another by the tailpiece position on the resonator and, therefore, for the used tailpiece type.

In conventional classical or acoustic guitars, for example, strings are connected to the sound board by a tailpiece fixed, and usually glued, to the sound board itself.

In this case the tailpiece comprises a bridge-shaped element, usually named saddle, or anyway it acts as a bridge-shaped element too, in particular to keep the necessary distance between the sound board and the strings of the instrument and to transfer the string vibration to the sound board.

In detail, in this kind of solution, the strings are fixed to one end at an end portion of the instrument and in particular they are fixed, usually thanks to suitable mechanical parts, to a distal end of the guitar handle, whereas at the other end they are fixed to the tailpiece that, in its turn, is fixed to the sound board.

The fixing of the strings of the afore considered type causes some strain to the instrument and precisely a tractive force acting thereon, therefore on the sound board towards the instrument strings, which is usually countered by strengthening the sound board through reinforcing elements.

The reinforcing elements are, in practice, wood strips named "braces", arranged on the side of the sound board opposite to that one where the tailpiece is fixed, therefore inside the resonance box.

During liutery evolution the so-called braces, in addition to perform a structural function, just to reinforce and counter the tractive force applied by the strings, have little by little adopted a functional task too and precisely the task of distributing and better orienting vibrations on the sound board, as a matter of fact nowadays the known art provides several bracing patterns of a sound board, especially concerning guitars.

Even if advantageous, a solution like that one considered above is not free from drawbacks among which a restricted vibration possibility of the sound board.

In fact, the braces are real structural constraints that stiffen the sound board thereby limiting its vibration possibility and, therefore, they substantially limit the sound performance of the instrument.

The second technique employed in liutery is typical of string instruments called "bowed string instruments" and of some particular guitar types, and is characterized in that is comprises a tailpiece and a saddle which are distinct and separated from one another.

In this case, the tailpipe is fixed to the sound box laterally, in a position opposite to the instrument handle, and precisely it is fixed on a side rib of the sound box, whereas the saddle on which the string rest, that is comprised between the handle and the tailpiece, is bound to the sound board of the instrument.

In this embodiment the string strain generates a compressive force on the instrument and the sound board, therefore a thrust on the sound board in a direction opposite to the strings, such a thrust being also in this case countered by the use of braces of the afore said type, or by supporting rods extending in the sound box from a bottom thereof to the sound board, such as in the bower string instruments.

Similarly to what considered before, also in this case the braces, as the rods, are real structural constraints limiting the vibration possibility of the sound board and therefore limiting the sound performance of the instrument.

Furthermore, in some solutions provided by the known art, in addition to reinforcements constituted by braces or rods, convex sound boards are used instead of essentially flat ones.

The arched shape of the sound board assures greater capacity, i.e. strength, against the compressive force applied by strings, but also in this case the vibration possibility of the sound board is limited with a consequent negative influence on sound/acoustic performances of the instrument.

SUMMARY OF THE INVENTION

The technical problem underlying the present invention has been to provide a string instrument having structural and functional characteristics such to overcome the afore mentioned drawbacks referring to the known art, and in particular a string instrument with resonator having greater elasticity and flexibility both from the structural and acoustic point of view, with respect to known string instruments, therefore a string instrument of the afore said type with better and preferably adjustable sound timbre, which results at the same time as solid, if not more, of the string instruments with usual resonator of the known art.

The afore said problem is solved by a string instrument comprising a resonator, a handle and a tailpiece substantially opposed to the handle, wherein the afore said handle and the afore said tailpiece are bound to the afore said resonator for combining at least one string to the afore said instrument, the afore said instrument further comprising at least one couple of magnets (pairs of magnets) essentially opposed each other, and in particular at least one first magnet combined with the afore said resonator and at least one second magnet arranged at a first distance from the afore said first magnet, so that to apply, between the afore said at least one first magnet and the afore said at least one second magnet, a repulsive force or an attractive force, respectively, depending on the opposed polarities, equal or opposite, of the afore said at least one first magnet and the afore said at least one second magnet, the afore said attractive force or the afore said repulsive force being active on the afore said resonator.

Substantially, according to the invention, the interaction with the afore said couple of magnets causes, on the afore said resonator, a thrust force towards the at least one string (away from the instrument) or, respectively, an attractive force in a direction away from the at least one string (towards the instruments).

Preferably the afore said instrument comprises first movement means for the displacement of at least one from the afore said first magnet and the afore said second magnet of the afore said at least one couple of magnets with respect to the other from the afore said first magnet and the afore said second magnet of the afore said at least one couple of magnets, to adjust the afore said first distance between the afore said first magnet and the afore said second magnet of the afore said at least one couple of magnets.

According to the invention, the afore said first distance between the afore said first magnet and the afore said second magnet can be further adjusted, according to needs, so that also between the afore said first magnet and the afore said second magnet there will be no interaction, and in particular the afore said attractive force or the afore said repulsive force are not present.

Preferably the afore said resonator comprises a sound board.

Preferably the afore said resonator comprises a sound box wherein the afore said sound board constitutes at least one portion of a side of the afore said sound box.

Preferably the afore said sound box comprises a back and a side rib extended between the afore said sound board and the afore said back.

Preferably the afore said sound box comprises at least one sound hole communicating between the inside and the outside of the sound box.

Preferably the afore said at least one sound hole is extended at least in part on the afore said side rib.

Preferably the afore said first magnet and the afore said second magnet of the afore said at least one couple of magnets are arranged on the same side with respect to the afore said sound board, and more preferably they are arranged inside the afore said sound box.

Preferably the afore said instrument comprises a bridge-shaped element (saddle) bound to the afore said tailpiece, or else interposed between the afore said tailpiece and the afore said handle, wherein the afore said bridge-shaped element is apt to tighten the afore said at least one string and to transfer the vibrations of the afore said at least one string to the afore said resonator.

Preferably the afore said instrument comprises a plurality of couples of magnets of the afore said type, therefore it preferably comprises a plurality of first magnets and a plurality of second magnets, wherein the magnets of each couple of magnets are essentially opposed one to another, and wherein preferably the couples of magnets of said plurality of couples of magnets are essentially arranged at least next to said bridge-shaped element.

Preferably the afore said tailpiece comprises at least one first portion apt to fix the afore said at least one string, wherein the afore said at least one first portion of the afore said tailpiece has a second adjustable distance from the afore said resonator, and preferably from the afore said sound board, the afore said instrument further comprising second movement means acting on the afore said tailpiece for the adjustment of the afore said second distance.

According to what hereinbefore described and to an embodiment of the invention, in the afore said instrument the afore said tailpiece is bound to a front portion of the afore said tailpiece, therefore is preferably bound to the afore said sound board, the afore said bridge-shaped element is bound to the afore said tailpiece and the afore said force applied between the afore said at least one couple of magnets is an attractive force.

Still according to what hereinbefore described and to another embodiment of the invention, in the afore said instrument the afore said tailpiece is bound to a side portion of the afore said resonator, therefore is preferably bound to the afore said side rib of the afore said sound box, the afore said bridge-shaped element is interposed between the afore said handle and the afore said tailpiece and the afore said force applied between the afore said at least one couple of magnets is a repulsive force.

According to the invention and to what hereinbefore described, the afore said instrument is preferably a guitar, a bass, a double bass, a mandolin, a violin, a viola, a cello or a similar string instrument having a tailpiece combined with a resonator.

Substantially, according to the invention, a string instrument is provided that has a resonator as element integral with the instrument itself, which comprises at least one couple of magnets, in which the attractive force or the repulsive force between the magnets, which can be determined depending on the arrangement of the respective polarities opposed one to another, balances or anyway counters the tractive force or, respectively, the compressive force generated on the instrument, and particularly on the resonator, by the strain of the at least one string extended between the tailpiece and an end of the instrument handle.

Therefore, according to what hereinbefore described, two magnets with opposed and equal polarities, then with north (or positive) polarity or south (or negative) polarity, and essentially arranged one in front of the other, would determine a repulsive force apt to counter the compressive force generated by the tailpiece and the bridge-shaped element, through the straining of the at least one string, in particular in case wherein the tailpiece is bound to the resonator laterally.

Still according to what hereinbefore described, two magnets with opposed and opposite polarities, then with north (or positive) polarity or south (or negative) polarity, or vice versa, and essentially arranged one in front of the other, would determine an attractive force apt to counter the tractive force generated by the tailpiece and the bridge-shaped element, through the straining of the at least one string, in particular in case wherein the tailpiece is bound to the resonator frontally.

According to the invention and, in particular, with this latter case of instrument with tailpiece bound to the resonator frontally, an equivalent solution to what above stated is to use, rather than a couple of magnets, a magnet and a ferromagnetic or paramagnetic element, for example a ferrous insert, in order to cause an attractive force with one another and, therefore, to cause the resonator to apply a force countering the tractive force generated by the tailpiece through the straining of the at least one string.

Analogously, still according to the invention and, in particular, with the case of instrument with tailpiece bound to the resonator laterally, an equivalent solution to what above stated is to use, rather than a couple of magnets, a magnet and a diamagnetic element, for example a silver or copper insert, in order to cause a repulsive force with one another and, therefore, to cause the resonator to apply a force countering the compressive force generated by the tailpiece and the bridge-shaped element through the straining of the at least one string.

According to the invention and to what stated above the magnet combined with the resonator, or the afore said ferromagnetic, or paramagnetic or diamagnetic element, can be bound to the resonator directly, or else it can be bound to the resonator indirectly, for example by joining elements or supporting elements.

BRIEF DESCRIPTION OF THE FIGURES

Further characteristics and advantages of the invention will be more evident from a review of the following specification of some preferred, but not exclusive, embodiments shown for illustration purposes only and without limitation, with the aid of the attached drawings, in which.

DETAILED DESCRIPTION OF THE INVENTION

Figure 2:
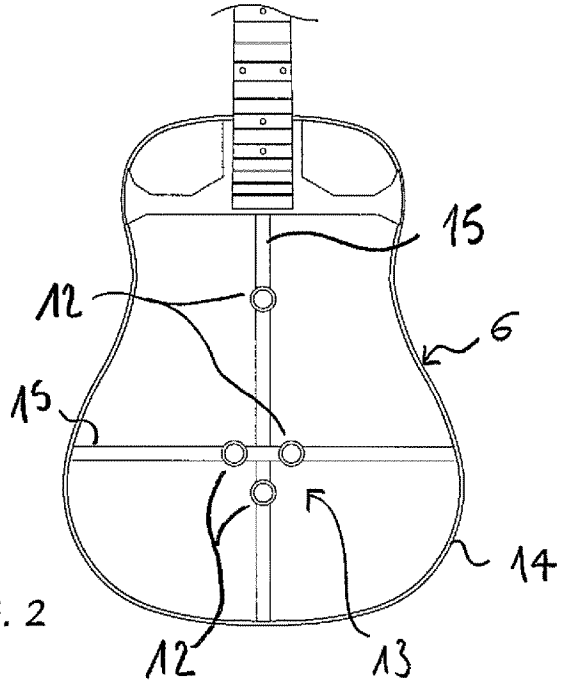
FIG. 2 depicts a portion of the string instrument of FIG. 1 with separated parts.
Figure 1:
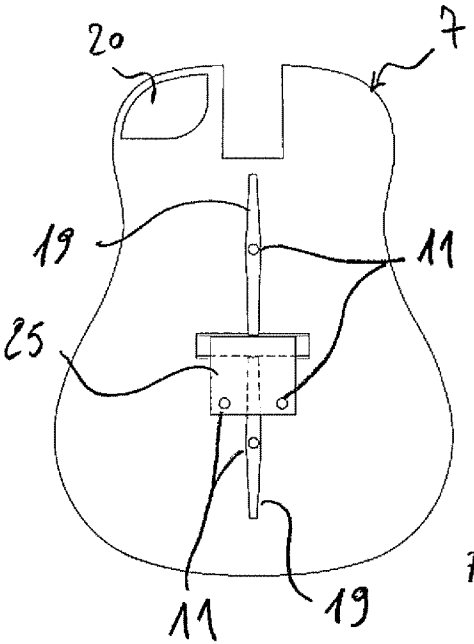
FIG. 1 depicts schematically a front view of a string instrument with resonator in accordance with an embodiment of the present invention.
Figure 1:
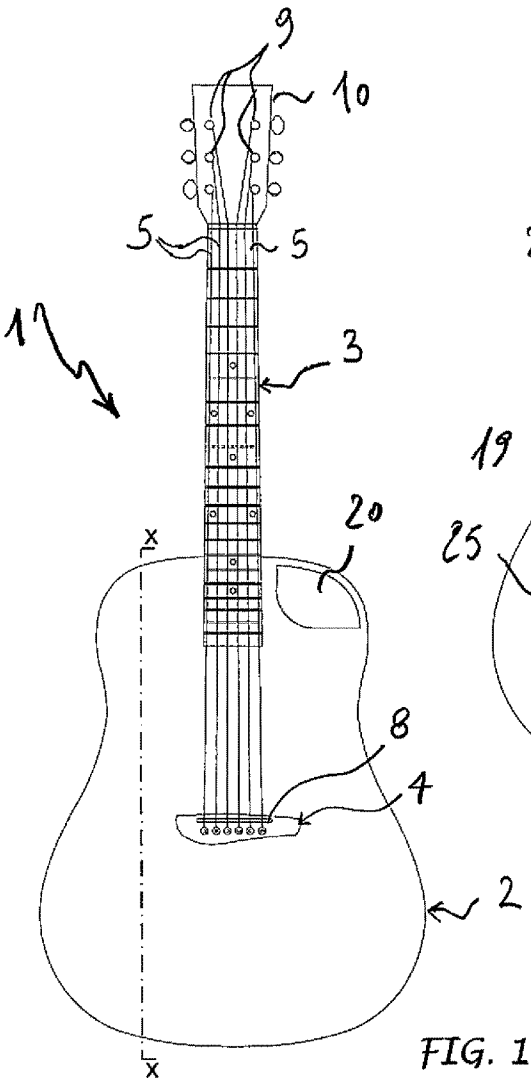
Figure 3:
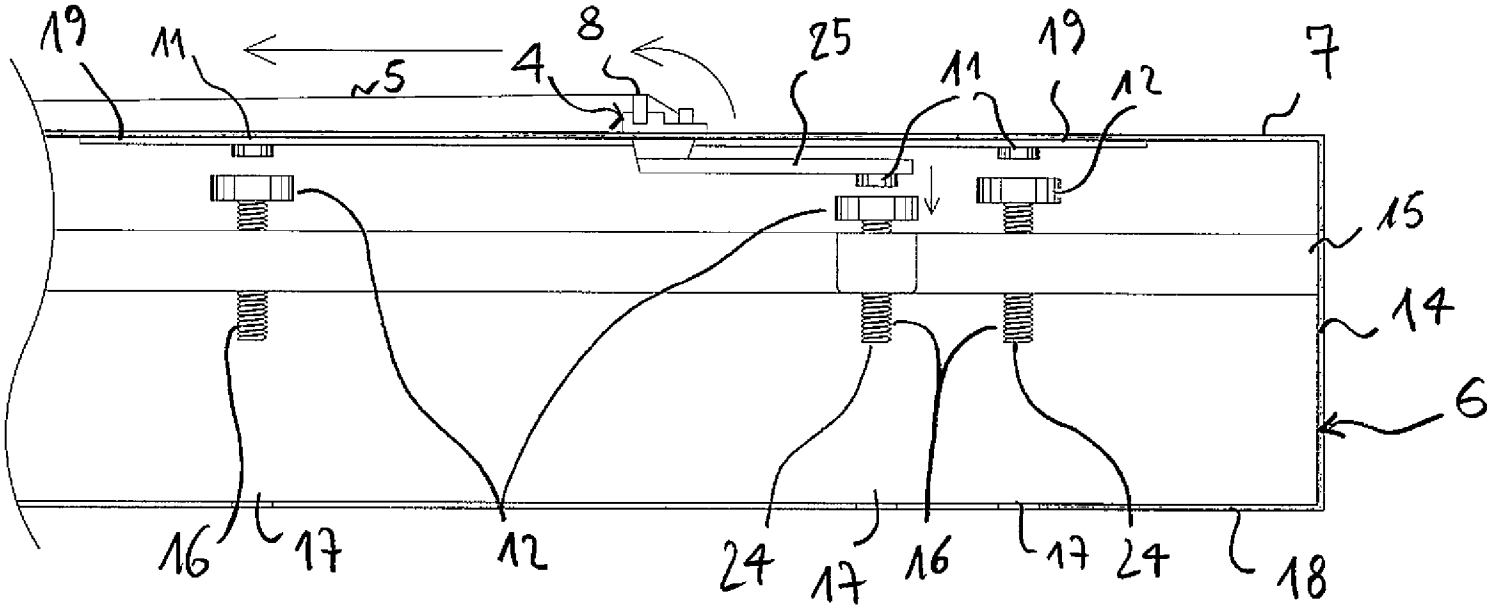
FIG. 3 depicts a side view along the axis X-X of FIG. 1, of a detail of the instrument in accordance with the present invention.
Figure 5:
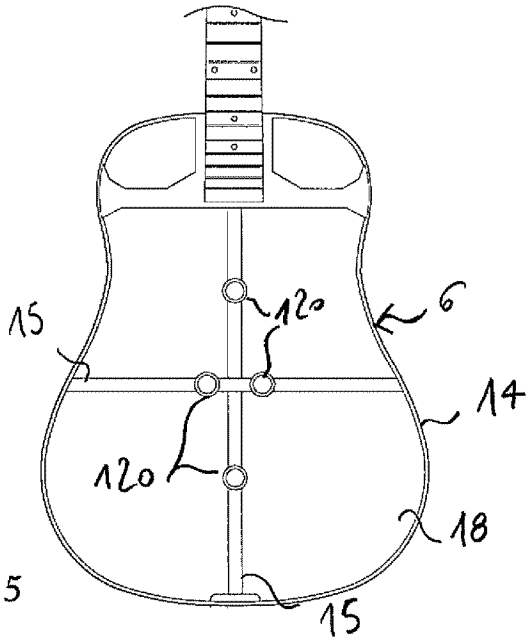
FIG. 5 depicts a portion of the string instrument of FIG. 4 with separated parts.
Figure 4:
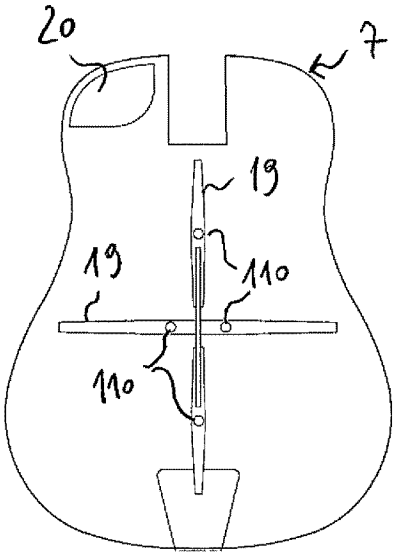
FIG. 4 depicts schematically a front view of a string instrument with resonator in accordance with another embodiment of the present invention.
Figure 4:
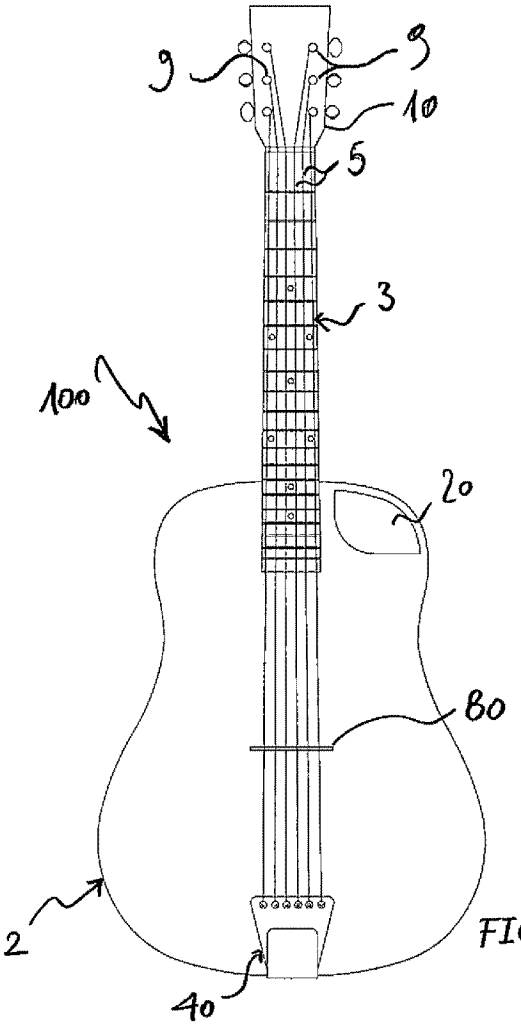
Figure 6:
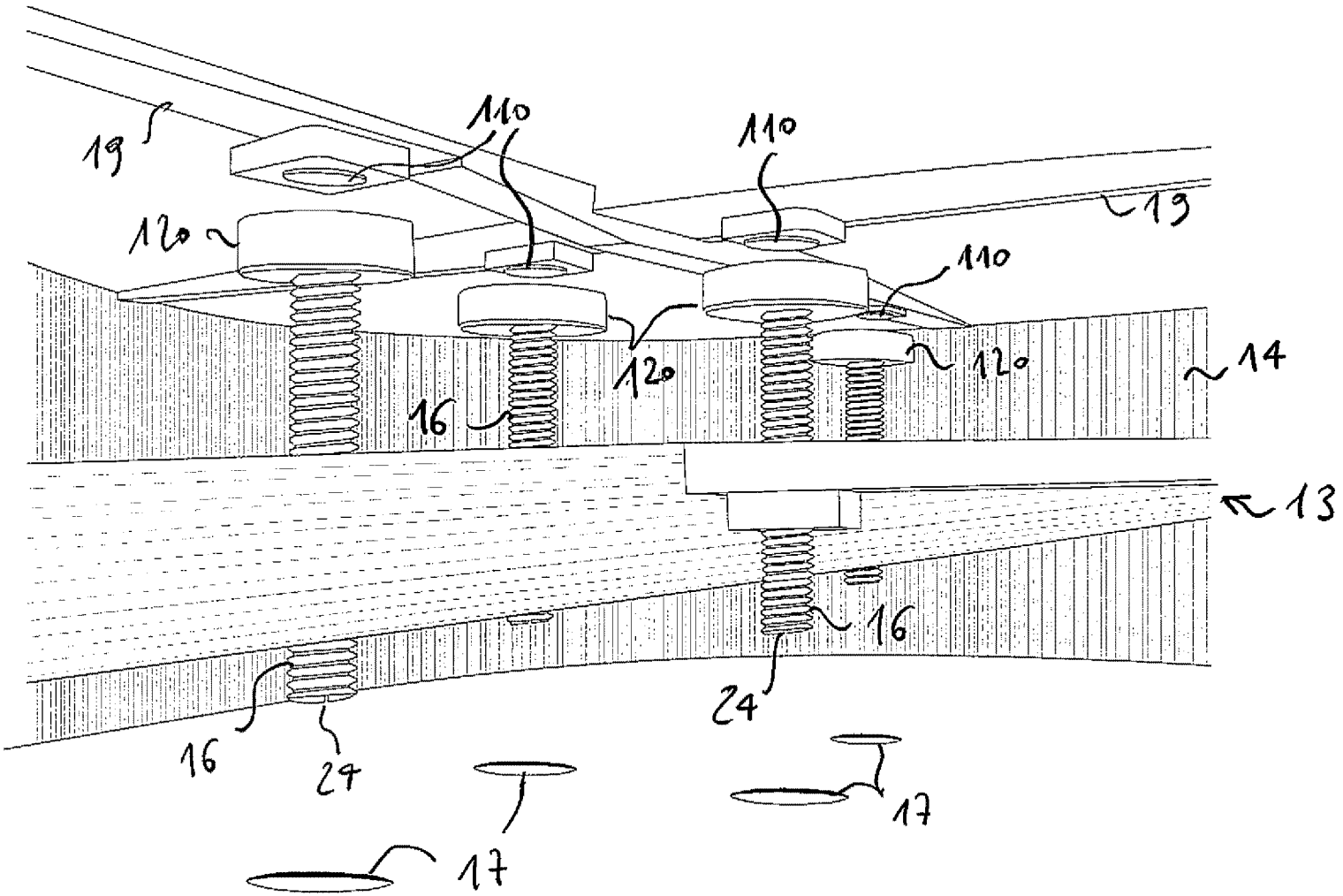
FIG. 6 depicts an inner and perspective view of a detail of the instrument of FIG. 4.

Referring to FIGS. 1-3, with the numeral 1 a chordophone is denoted on the whole, i.e. a musical string instrument, specifically a guitar, more particularly a guitar named classical or acoustic.

The instrument 1 comprises essentially a resonator 2, a handle 3 and a tailpiece 4 arranged essentially in line with the handle 3, wherein the handle 3 and the tailpiece 4 are constrained to the resonator 2 in order to combine at least one string to the instrument 1, specifically six strings depicted with numeral 5 on the whole.

In detail, the resonator 2 comprises a sound box 6 whose side facing the strings 5 is closed by a sound board 7 on which the tailpiece 4 is bound.

In a known way, the tailpiece 4 is provided with a bridge-shaped element 8 (saddle) and a plurality of passages for the strings 5, the latter then having a first end fixed to the tailpiece 4 itself whereas a second opposed end of the strings 5 is fixed to the handle 3 at a portion thereof distal with respect to the resonator 2, therefore to the tailpiece 4 itself.

In particular, the second end of the strings 5 is fixed to the handle 3 by suitable mechanical parts 9 adjustable to tune the instrument, which are arranged on a handle portion named headstock depicted with numeral 10.

According to the invention, the instrument 1 further comprises a plurality of couples of magnets, wherein the magnets of each couple are essentially arranged mutually opposed, and in particular according to the examples of the afore said figures it comprises four couples of magnets.

Precisely, the instrument 1 comprises four first magnets 11 combined with the resonator 2, which are specifically bound to the sound board 7 at one side thereof inside the sound box 6, and four second magnets 12 arranged in front of the first magnets 11, at respective first distances, and housed inside the sound box 6.

The first distances among the first magnets 11 and the second magnets 12 can be the same or different from one another, and in every case, according to another aspect of the invention, they can be adjusted also independently from one another, as it will be better evident in the following.

Still in accordance to the present invention and the examples of FIGS. 1-3, the first magnets 11 and the second magnets 12 are arranged so that opposite polarities are opposed one to the other, therefore so that they apply an attractive force one to another.

In this way also an attractive force is applied to the resonator 2 and, particularly, to the sound board 7, i.e. a force towards the instrument 1 that advantageously counters the tractive force the strings 5 of the instrument 1 apply on the sound board 7 when they are tightened for the instrument use.

From a purely structural point of view, still according to the examples of FIGS. 1-3, the instrument 1 comprises supporting means 13 for sustaining the second magnets 12 housed inside the sound box 6 and bound to a side rib 14 of the latter, the possibility of providing supporting means bound to the back of the sound box not being excluded.

Concretely, the supporting means 13 are a frame comprising a plurality of crosspieces 15, the possibility of providing supporting means substantially paneled not being excluded in order to make a double compartment in the sound box, and in particular a first compartment comprised between the sound board and the paneled supporting means, and a second compartment comprised between the paneled supporting means and the back of the sound box, the latter possibilities not being in the illustrated figures.

In detail, the second magnets 12 are combined with the supporting means 13 and, precisely, they are advantageously arranged at the crosspieces 15 by suitable movement means, herein denoted as first movement means 16, that allow adjusting the relative first distances individually from the respective first magnets 11.

In this regard, the first movement means 16 comprise a plurality of threaded rod-shaped elements, as many as the couples of magnets, which removably engage the respective through holes provided in the crosspieces 15, the second magnets 12 being fixed on the ends thereof proximal to the sound board 7.

For driving the first movement means 16, therefore for accessing to the threaded rod-shaped elements, the instruments 1 comprises also openings 17 that can be in case closed, provided in the sound box 6 in particular on the back 18 thereof opposed to the sound board 7.

Substantially, the first movement means 16 allow moving the second magnets 12 closer or away to/from the first magnets 11, to respectively increase or decrease the interaction force among them, in case to the point of making it null.

For this purpose the first movement means 16, therefore the threaded rod-shaped elements, comprise leading parts 24 for their movement by a tool, for example a screwdriver.

Referring to the first magnets, it has to be mentioned that they can be directly bound to the sound board, for example by suitable fixing means, or they can be housed, possibly by interlocking them, in suitable seats provided in the sound board and/or they can be bound indirectly to the sound board by the interposition of suitable joining or supporting elements.

In each case, in accordance with the invention, both the first magnets and the second magnets are preferably removable from the instrument 1, therefore they can be replaced if needed.

In detail, in accordance with what hereinbefore described and the examples of the afore said figures, the instrument 1 comprises adhesive strips 19 for directly combining two first magnets 11 with the sound board 7, in particular two first magnets longitudinally arranged in the instrument 1, and it comprises also a lever element 25 for indirectly combining the other two first magnets 11 with the sound board 7, in particular two first magnets arranged transversely in the instrument 1.

As depicted in the example of FIG. 3, the lever element 25 is integral with the tailpiece 4 and, substantially, constitutes a support for the afore said two first magnets 11.

In this way, the interaction among the first magnets and the second magnets 12, at the lever element 25, counters the torsional force the bridge-shaped element 8 is subjected to, caused by the traction of the strings 5, as particularly shown in the example of FIG. 3 by the arrows.

Still advantageously, the couples of magnets are arranged with regular geometry with respect to the handle 3 and/or with respect to the tailpiece 4, therefore with respect to the bridge-shaped element 8.

The instrument 1 further comprises a sound hole 20 having acoustic functions and provided in the sound box 6 at a peripheral portion of the sound board 7, the possibility of providing such a sound hole in, or also in, the side rib of the sound box not being excluded.

Referring to FIGS. 4-7, a variation of the implementation of the string instrument according to the invention is described, which is depicted with numeral 100 on the whole and whose parts structurally and functionally corresponding to those of the above depicted instrument 1 have the same reference numerals.

The instrument 100, specifically still a so-called classical or acoustic guitar, differs from the previously described instrument 1, to which reference is made, essentially for the tailpiece position, therefore in that it provides for a tailpiece and a bridge-shaped element separated and placed at a given distance from one another, and in that magnets interacting to one another are provided and develop a repulsive force.

In brief, the instrument 100 comprises essentially a resonator 2, a handle 3 and a tailpiece 40 arranged substantially as opposed to the handle 3, wherein the handle 3 and the tailpiece 40 are bound to the resonator 2 in order to combine a plurality of strings 5 to the instrument 100.

In its turn, the resonator 2 comprises a sound box 6 comprising essentially a back 18 and a sound board 7 among which a side rib 14 is comprised.

In a known way, the tailpiece 40 is provided with a plurality of passages for the strings 5, which have a first end fixed to the tailpiece 40 itself whereas a second opposed end of the strings 5 is fixed to the handle 3 at a portion thereof distal with respect to the resonator 2.

In particular, the second end of the strings 5 is fixed to the handle 3 by suitable mechanical parts 9 adjustable to tune the instrument, which are arranged on a handle portion named headstock depicted with numeral 10.

According to this variation of the implementation, the tailpiece 40 is bound to the resonator 2 laterally, i.e. it is bound to the side rib 14 of the sound box 6 in a position substantially opposite to the handle 3, whereas a bridge-shaped element (saddle) 80 is frontally combined with the resonator 2, therefore it is bound to the sound board 7 in a position comprised between the handle 3 and the tailpiece 40.

According to the invention, the instrument 100 further comprises a plurality of couples of magnets, wherein the magnets of each couple are essentially arranged mutually opposed, and in particular according to the examples of the FIGS. 4-7 it comprises four couples of magnets.

Precisely, the instrument 100 comprises four first magnets 110 combined with the resonator 2, which are specifically bound to the sound board 7 at the side thereof inside the sound box 6, and four second magnets 120 arranged in front of the first magnets 110, housed inside the sound box 6.

The respective first distances among the first magnets 110 and the second magnets 120 can be the same or different from one another, and in every case, according to the invention, they can be adjusted also independently from one another.

Still in accordance to the present invention and the examples of FIGS. 4-7, the first magnets 110 and the second magnets 120 are arranged so that opposed polarities are equal to one another, therefore so that they apply a repulsive force one to another.

In this way also a repulsive force is applied to the resonator 2 and, particularly, to the sound board 7, i.e. a force substantially outwards the instrument 100 that advantageously counters the compressive (pressure) force the strings 5 of the instrument 100 apply on the sound board 7 when they are tightened for the instrument use, in particular by the bridge-shaped element 80.

From a purely structural point of view, still according to the examples of FIGS. 4-7, the instrument 100 comprises supporting means 13 for sustaining the second magnets 120 housed inside the sound box 6 and bound to the side rib 14 of the latter, the possibility of providing supporting means bound to the back of the sound box not being excluded.

Concretely and advantageously, the supporting means 13 are a frame comprising a plurality of crosspieces 15, the possibility of providing supporting means substantially paneled not being excluded in order to make a double compartment in the sound box, and in particular a first compartment comprised between the sound board and the paneled supporting means, and a second compartment comprised between the paneled supporting means and the back of the sound box, the latter possibilities not being in the illustrated figures.

In detail, the second magnets 120 are combined with the supporting means 13 and, precisely, they are advantageously arranged at the crosspieces 15 by suitable movement means, herein denoted as first movement means 16, that allow adjusting the respective first distances individually from the first magnets 110.

In this regard, the first movement means 16 comprise a plurality of threaded rod-shaped elements, as many as the couples of magnets, which removably engage the respective through holes provided in the crosspieces 15, the second magnets 120 being fixed on the ends thereof proximal to the sound board 7.

For driving the first movement means 16, therefore for accessing to the threaded rod-shaped elements, the instruments 100 comprises also openings 17 that can be in case closed, provided in the sound box 6 in particular on the back 18 thereof opposed to the sound board 7.

Substantially, the first movement means 16 allow moving the second magnets 120 closer or away to/from the first magnets 110, to respectively increase or decrease the interaction force among them, in case to the point of making it null.

For this purpose the first movement means 16, therefore the threaded rod-shaped elements, comprise leading parts 24 for their movement by a tool, for example a screwdriver.

Referring to the first magnets, it has to be mentioned that they can be directly bound to the sound board, for example by suitable fixing means, or they can be housed, possibly by interlocking them, in suitable seats provided in the sound board and/or they can be bound indirectly to the sound board by the interposition of suitable joining or supporting elements.

In case of the examples of FIGS. 4-7 a plurality of adhesive strips 19 are provided for a direct combining of the first magnets with the sound board 7.

In each case, in accordance with the invention, both the first magnets and the second magnets are preferably removable from the instrument 100, therefore they can be replaced if needed.

Advantageously, the couples of magnets are further arranged with regular geometry with respect to the handle 3 and/or with respect to the tailpiece 40, therefore with respect to the bridge-shaped element 80.

The instrument 100 further comprises a sound hole 20 having acoustic functions and provided in the sound box 6 at a peripheral portion of the sound board 7, the possibility of providing such a sound hole in, or also in, the side rib of the sound box not being excluded.

In accordance with another aspect of the invention, the tailpiece 40 comprises a first portion 21 proximal to the handle 3, practically the portion with the holes for the passage of the strings 5 that has a second distance adjustable from the resonator 2 and, in particular, from the sound board 7.

The movement of such a first portion 21 advantageously allows adjusting the distance of the strings from the sound board, in particular depending on the action the interaction among the couples of magnets causes in the sound board.

In this regard, the instrument 100 comprises second movement means 22 acting on the tailpiece 40 for adjusting the position of the first portion 21 of the tailpiece, therefore for adjusting the afore said second distance.

Figure 7:
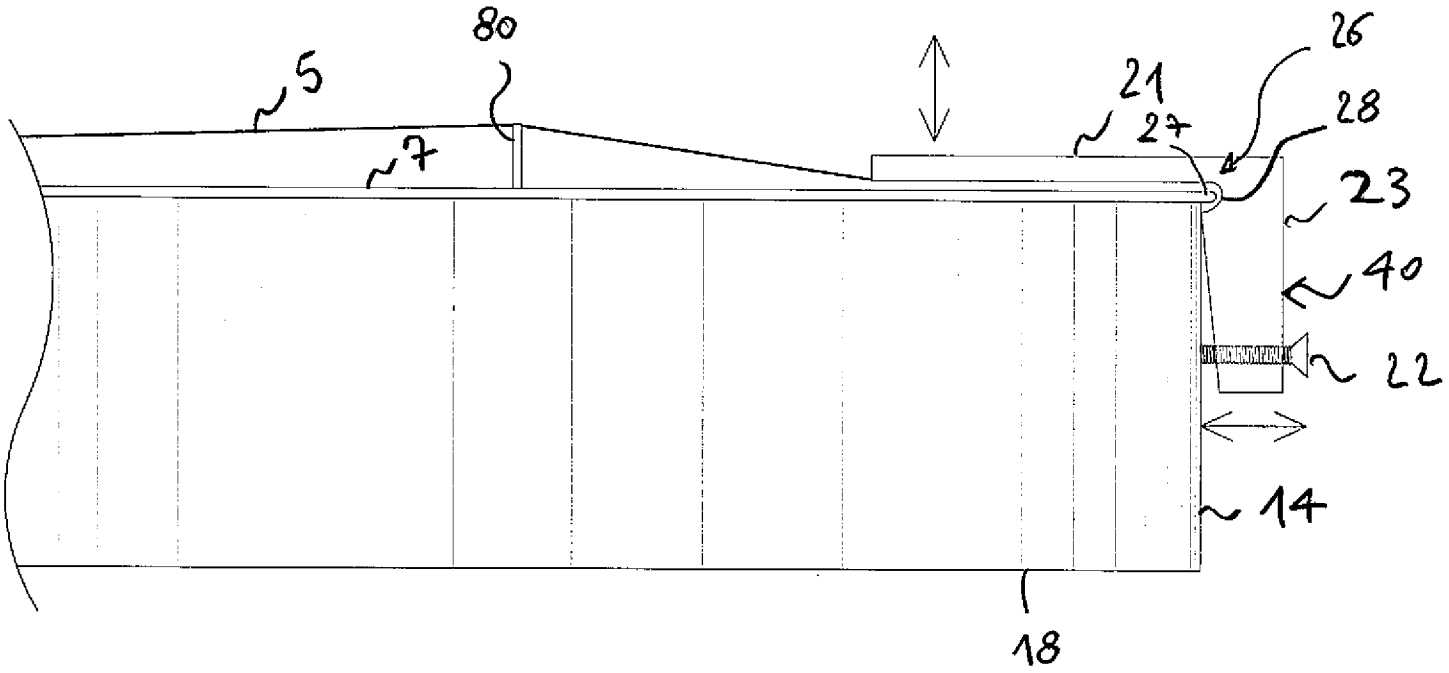
FIG. 7 depicts a side view of another detail of the instrument of FIG. 4.

In accordance with the example of FIG. 7, the second movement means 22, substantially constituting also means combining the tailpiece with the resonator, are a flathead screw bounding the tailpiece 40 to the side rib 14 of the sound box 6, in particular at a second portion 23 of the tailpiece 40 distal from the handle 3.

By acting on the second movement means moving closer or away from the sound box, the first portion of the tailpiece moves closer or away, along a substantially orthogonal direction, to/from the sound board, as particularly shown by the arrows of the example in FIG. 7.

In this regard, in order to stabilize the combining and the movement between the tailpiece 40 and the resonator 2, the instrument 100 comprises coupling means 26 that advantageously are a projection 27 and a throat 28 engaged by the projection 27, wherein the projection 27 extends from the sound board 7 beyond the side rib 14 of the sound box 6 and the throat 28 is obtained on the tailpiece 40 substantially in a junction area between the first and the second tailpiece portions.

The advantages of the present invention, already become evident during the afore stated description, can be summarized by pointing out that a string instrument is provided that has a resonator as integral part of the instrument, with an improved structural flexibility becoming a better sound performance with respect to similar string instruments provided by the known art, all preserving the necessary toughness.

In fact, the instrument according to the present invention allows an improved propagation of the sound waves to the resonator, therefore of vibrations generated by the strings, thereby increasing the sound volume of the instrument, as it were.

In order to meet incidental and specific requirements, several variations and modifications could be made by a field technician to the illustrated and described embodiments of present invention, provided that all are included in the scope of protection of the invention as defined by the following claims.

The invention claimed is:

1. A string instrument (1; 100) comprising a resonator (2), a handle (3) and a tailpiece (4; 40), wherein said handle (3) and said tailpiece (4; 40) are bound to said resonator (2) for combining at least one string to said instrument, said instrument comprises at least one magnet pair generally opposed each other, a first magnet (11; 110) of said at least one magnet pair being bound to said resonator (2), a second magnet (12; 120) of said at least one magnet pair being arranged at a first distance from said first magnet, so that to apply, between said first magnet (11; 110) and said second magnet (12; 120), a repulsive force or an attractive force, respectively, depending on the opposed polarities, equal or opposite, of said first magnet and said second magnet, said attractive force or said repulsive force being active on said resonator (2), wherein said string instrument further comprises a plurality of magnet pairs including respective pluralities of said first and second magnets.

2. The string instrument according to claim 1, further comprising first movement means (16) for the displacement of at least one from said first magnet (11; 110) and said second magnet (12; 120) of said at least one magnet pair with respect to the other from said first magnet (11; 110) and said second magnet (12; 120) of said at least one magnet pair, to adjust said first distance between said first magnet (11; 110) and said second magnet (12; 120) of said at least one magnet pair.

3. The string instrument according to claim 1, wherein said resonator (2) comprises a sound board (7).

4. The string instrument according to claim 3, wherein said first magnet (11; 110) and said second magnet (12; 120) of said at least one magnet pair are arranged on a same side with respect to said sound board (7).

5. The string instrument according to claim 3, wherein said resonator (2) comprises a sound box (6), said sound board (7) constituting at least one portion of a side of said sound box (6).

6. The string instrument according to claim 5, wherein said sound box (6) comprises a back (18) and a side rib (14) extended between said sound board (7) and said back (18), said sound box (6) comprising at least one sound hole.

7. The string instrument according to claim 1, further comprising a bridge-shaped element (8; 80) bound to said resonator (2), said at least one magnet pair being generally arranged at said bridge-shaped element.

8. The string instrument according to claim 1, wherein said tailpiece (4) is bound to a front portion of said resonator (2), said force applied between said at least one magnet pair being an attractive force.

9. The string instrument according claim 1, wherein said tailpiece (40) is bound to a side portion of said resonator (2), said force applied between said at least one magnet pair being a repulsive force.

10. A string instrument (1; 100) comprising a resonator (2), a handle (3) and a tailpiece (4; 40), wherein said handle (3) and said tailpiece (4; 40) are bound to said resonator (2) for combining at least one string to said instrument, said instrument comprises at least one magnet pair generally opposed each other, a first magnet (11; 110) of said at least one magnet pair being bound to said resonator (2), a second magnet (12; 120) of said at least one magnet pair being arranged at a first distance from said first magnet, so that to apply, between said first magnet (11; 110) and said second magnet (12; 120), a repulsive force or an attractive force, respectively, depending on the opposed polarities, equal or opposite, of said first magnet and said second magnet, said attractive force or said repulsive force being active on said resonator (2) wherein said tailpiece (40) comprises at least one first portion (21) apt to be combined with said at least one string, wherein said at least one first portion (21) of said tailpiece (40) has a second adjustable distance from said resonator (2), said instrument (100) comprising second movement means (22) acting on said tailpiece (40) for the adjustment of said second distance.

11. The string instrument according to claim 1, wherein said instrument is: a guitar, a bass, a double bass, a mandolin, a violin, a viola, or a cello.

* * * * *